United States Patent [19]

Slaats et al.

[11] Patent Number: 4,469,382

[45] Date of Patent: Sep. 4, 1984

[54] DESK LOCKING MECHANISM

[75] Inventors: Mathew A. Slaats; Jay M. Henriott; Paul R. Hedinger, all of Jasper; Steven F. Trinkel, Rockport, all of Ind.

[73] Assignee: Kimball International, Inc., Jasper, Ind.

[21] Appl. No.: 441,548

[22] Filed: Nov. 15, 1982

[51] Int. Cl.[3] ..... E05P 65/44

[52] U.S. Cl. ..... 312/219; 312/194; 312/201; 312/217; 312/218

[58] Field of Search ..... 312/215, 216, 217, 218, 312/219, 201, 194; 74/501.5; 292/157, 166, 171

[56] References Cited

U.S. PATENT DOCUMENTS

| | | | |
|---|---|---|---|
| 606,556 | 6/1898 | Keith . | |
| 1,336,183 | 4/1920 | Bahr . | |
| 1,943,099 | 1/1934 | Tobey . | |
| 2,547,513 | 4/1951 | Wikman | 312/218 |
| 2,550,669 | 5/1951 | Brickman | 74/501 |
| 3,109,686 | 11/1963 | Watts et al. | 312/214 |
| 3,291,547 | 12/1966 | Foster . | |
| 3,360,318 | 12/1967 | Studinski . | |
| 3,363,955 | 1/1968 | Schreyer . | |
| 3,589,783 | 10/1968 | Studinski et al. . | |
| 3,664,720 | 5/1972 | Thomas . | |
| 3,728,662 | 4/1973 | Puri | 312/320 X |
| 3,776,007 | 12/1973 | Kitchener . | |
| 3,892,228 | 7/1975 | Mitsui | 74/501.5 |
| 3,920,297 | 11/1975 | Brandes . | |
| 3,941,441 | 3/1976 | Scheerhorn . | |
| 3,998,508 | 12/1976 | Scheerhorn . | |
| 4,010,989 | 3/1977 | Klug | 312/215 |
| 4,026,616 | 5/1977 | Kuehl | 312/201 X |
| 4,057,306 | 11/1977 | Resch, Jr. . | |
| 4,057,307 | 11/1977 | Scheerhorn . | |

*Primary Examiner*—William E. Lyddane
*Assistant Examiner*—Joseph Falk
*Attorney, Agent, or Firm*—Jeffers, Irish & Hoffman

[57] ABSTRACT

A remote control locking mechanism is provided for a modular desk assembly, pedestals, cabinets and like assemblies which permits the various storage compartments to be moved about and yet still be locked and unlocked irrespective of their location relative to a remote control lock actuator. Each of the various storage compartments has a locking device attached thereto which is connected to the remote control lock actuator by a cable which is slidably encased within a sheath. The sheath has one end anchored at the particular storage compartment and its opposite end anchored at the remote control lock actuator. One end of the cable is connected to the locking device of the storage compartment and its opposite end connected to a moving device within the remote control lock actuator. The length of the sheath may be greater than the distance between the storage compartment and remote control lock actuator to thereby permit the storage compartment to be moved relative thereto within the length of the sheath, and, upon actuation of the moving device within the remote control lock actuator, the cable may be moved relative to the sheath to actuate the locking device at the storage compartment.

23 Claims, 13 Drawing Figures

DESK LOCKING MECHANISM

BACKGROUND OF THE INVENTION

This invention pertains to a work station locking system, and more particularly to a desk locking mechanism which permits various lockable storage compartments to be moved about relative to a work surface.

Several types of desk locking mechanisms are currently available and generally follow the design of two particular types. One of these involves the use of rigid bars or rods connecting the locking device of a storage compartment with a locking actuator. A typical embodiment of such a system installed in a desk having pedestals secured thereto comprises a primary locking device disposed in the work surface of the desk and secondary lock devices disposed at each pedestal desired to have a locking capability. A spring clip device is interposed between the primary and secondary locking devices and rigid rods or bars are interconnected between the primary locking device and spring clip and the spring clip and the secondary locking device. The spring clip serves to transfer the linear motion of the rigid bar connected to the primary locking device to the rigid bar connected to the secondary locking device.

A disadvantage of the desk locking mechanism utilizing rigid bars or rods to lock stationary pedestals is the difficulty in installing such a system within a desk assembly. The spring clip must be precisely positioned so that the linear motion of the rigid bar connected to the primary locking device is properly transferred to the rigid bar connecting the secondary locking device to the storage compartment. An incorrect placement of the spring clip between the two locking may devices cause the locking feature to be difficult or impossible to operate depending upon the amount of misalignment of the spring clip relative to the locking devices. Furthermore, such a system does not easily permit adjustment of the locking mechanism once installed, and if installation is incorrect, the system must be removed and correctly reinstalled.

Another disadvantage of the rigid bar locking system follows from the above in that the desk pedestals must be securely attached to the desk work surface so that accurate installation of the rigid bars and spring clip may be made. Consequently, if a particular storage compartment, for example, a filing cabinet, is desired to be moveable and lockable it must have its own primary locking device separate from the primary locking device for the desk pedestals. This requirement further increases labor and material costs since each moveable storage compartment must have its own separate primary locking device.

A further disadvantage with the above type desk locking mechanism is the elimination or degradation of flexibility when utilizing modular desk assemblies and the like. A modular desk assembly incorporating the above type desk locking mechanism would generally require a primary locking device for each separately moveable storage compartment.

A second type of prior art desk locking system utilizes a system of pulleys and cables to lock various storage compartments. Although it does not use rigid bars to connect the primary and secondary locking devices, this particular type of desk locking system has some of the disadvantages of the rigid bar locking system. For example, the storage compartments desired to have the capability of being locked generally must be secured to the work surface containing the primary locking device or stationary relative to the work surface. Once a particular storage compartment is secured to a work surface, the cable utilized in the pulley-cable locking system is cut to a particular length that is determined by the distance between the storage compartment and the work surface containing the primary locking device. Pulleys are disposed along points of the cable where a change of direction in the cable is necessitated by the placement of the storage compartment relative to the work surface. Here again, installation of such a system at the factory is difficult and time consuming due to the requirement of a predetermined length of cable precisely tensioned between the primary and secondary locking devices. Once installed, little or no adjusting is available to correct any error committed during the installation of the system. Furthermore, the longer the length of cable required to be tensioned between the primary and secondary locking devices or the more pulleys required to be installed along points of the cable length due to required changes of direction of the cable, the more difficult it is to install the system at the factory level. Such increased difficulties in installing a particular system result in higher labor and material costs.

The user of a pulley-cable desk locking system also does not have the flexibility of being able to move various storage compartments relative to the primary locking device without having to install a separate primary locking device within each moveable storage compartment.

SUMMARY OF THE INVENTION

The remote control work station locking mechanism of the present invention eliminates the disadvantages and problems inherent in the prior art desk locking mechanisms and provides certain features unique thereto.

The remote control locking mechanism eliminates the use of rigid bars or rods and the conventional pulleys of the pulley-cable desk locking system with the precise cable tensioning requirements thereof. This is accomplished by connecting a remote control lock actuator and a respective storage compartment lock device by a length of cable encased within a sheath. The sheath, which extends substantially the length of the cable, has one end anchored near the remote control lock actuator and its opposite end anchored near the lock device for the particular storage compartment. The cable slidably encased within the sheath has one end connected to the remote control lock actuator and its opposite end connected to the respective lock device. The length of the sheath is determined initially by the length of the cable, such being determined at the manufacturing level and installed within the sheath accordingly. The unique feature of this construction of a cable within a sheath of predetermined length permits the cable and sheath length to be greater than the distance between the remote control lock actuator and a respective storage compartment lock device.

For example, and in comparison with the pulley-cable locking mechanism of the prior art, if the distance between the storage compartment locking device and remote control lock actuator is approximately five feet, the length of the cable in the pulley-cable lock system of the prior art would closely approximate that particular five foot distance because of the necessity of tensioning the cable between the primary lock device and the secondary lock device. In contrast to this, the sheath and the cable slidably received therein could have a length approximating the five feet or a greater length to allow the storage compartment to be moveable relative to the remote control lock actuator. The capability of having a longer cable than the distance between the remote control lock actuator and the storage compartment lock device is possible due to the anchoring of the ends of the predetermined length of sheath near the remote control lock actuator and the storage compartment lock device, the length of the cable being determined by the length of the sheath. This depending relationship between the length of the cable and the sheath is predetermined and factory set, and once installed does not need further adjustments regardless of the distance between the storage compartment and the remote control lock actuator, thereby permitting the storage compartment to be moved as desired relative to the remote control lock actuator within the distance of the sheath.

Because of the possibility of production irregularities in manufacturing the remote control desk locking mechanism, the remote control lock actuator provides for fine adjustments in the length of the sheath. Such adjustments are relatively small, generally one-eighth of an inch, and are easily made by the user at any time.

Another advantage of the remote control desk locking mechanism is the feature that permits one remote control lock actuator to lock multiple work surfaces and other units which are separated therefrom. A plurality of sheaths, each slidably encasing its own cable therein, may be operably connected to a single remote control lock actuator regardless of the respective lengths of the sheaths. This would then permit a remote control lock actuator disposed within a desk work surface, for example, to not only lock storage compartments secured thereto, but also other desk work surfaces and storage compartments spaced therefrom. Naturally, units that are spaced from the remote control lock actuator would have their respective sheaths and cables hidden from view by means of carpeting, routing behind wall trim adjacent the floor, or within the walls themselves.

A further advantage of utilizing a single remote control lock actuator is the dispensing with the requirement of having the actuator housed or contained within the desk work surface. Such a remote control lock actuator could even be enclosed within its own secure housing in another element of the work station, in a remote area of the room or even out of the room containing the lockable storage compartments, thereby further adding to the security of the remote control desk locking mechanism.

Another security feature is the provision of automatic locking of a particular storage compartment if its cable and sheath are accidently or purposely severed or otherwise damaged thereby preventing the cable from easily sliding within the sheath. This is accomplished by providing bias means with the locking device of a storage compartment. The bias means is so arranged with the locking device that should the cable and sheath become severed or damaged, the bias means will automatically actuate the locking device to lock the storage compartment.

The remote control desk locking mechanism now allows the user a degree of flexibility in arranging or moving pedestals, cabinets, and the like not previously possible with current desk locking mechanisms, while still permitting the rearranged or moved pedestals, cabinets and the like to be locked by a single remote control lock actuator. Further, these particular types of storage compartments may be arranged or moved anywhere within the range of the cable's length without requiring any adjustments by the user to the locking system.

A further unique and distinct feature of the remote control desk locking mechanism, which results from the design of the system, is that the user may buy the system apart from a modular desk assembly or the like and install the system easily himself. Whether installed at the factory level or by the user, the remote control desk locking mechanism is reliable, easy to install, and virtually maintenance free as compared to the prior art desk locking mechanisms. Furthermore, costs in production, such as labor and material, are greatly reduced directly benefiting the purchasing user.

In one form of the invention there is provided a remote control locking mechanism for desks, pedestals, cabinets and like assemblies making up a work station including a plurality of storage compartments having closure means for the opening and closing thereof, and lock means at each storage compartment for locking the closure means. Also provided is a plurality of cables slidably encased in a respective plurality of sheaths extending from a remote actuator to the respective lock means, each of the sheaths encasing a substantial length of its respective cable and having its sheath end portions anchored in place, whereby the remote actuator moves the cables relative to the sheaths so as to actuate respective lock means for locking and unlocking closure means of the storage compartments.

It is an object of the present invention to provide a remote control work station locking mechanism which allows storage compartments to be moved about while still maintaining a locking capability.

Another object of the present invention is to provide a single lock actuator capable of locking both movable and immovable storage compartments.

Yet another object of the present invention is to provide a lock actuator that may be remotely positioned from storage compartments and work surfaces which are locked by the lock actuator.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
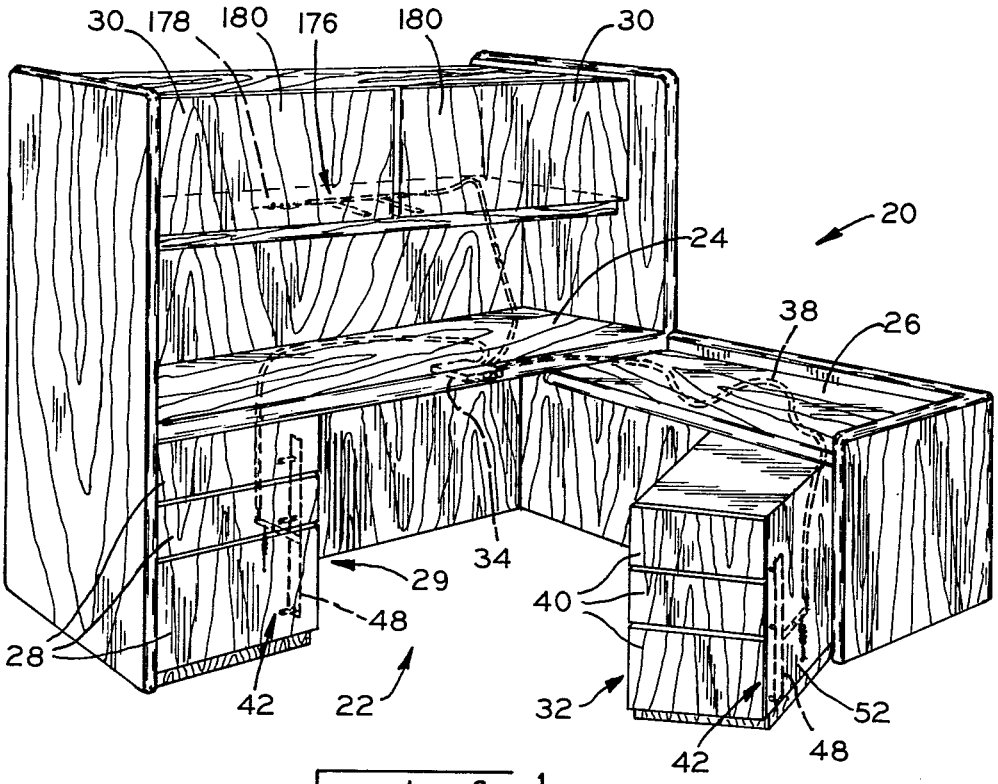
FIG. 1 is a perspective view of a modular desk assembly incorporating a preferred embodiment of the present invention.
Figure 2:
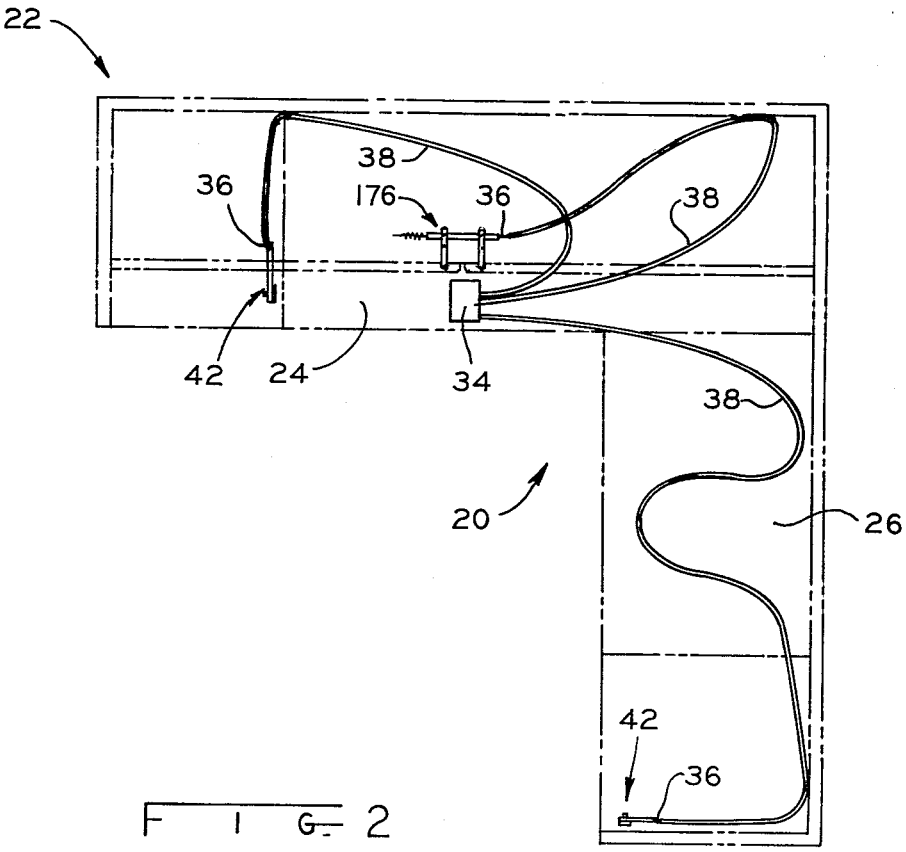
FIG. 2 is a schematic top plan view of FIG. 1 with the free standing pedestal in place.
Figure 3:
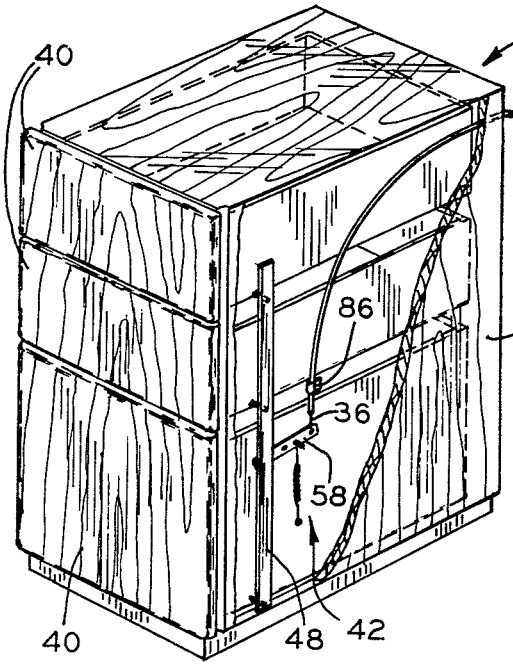
FIG. 3 is a perspective view of a free standing pedestal unit incorporating the locking device of a preferred embodiment of the present invention.

Referring to FIGS. 1 and 2, remote control desk locking mechanism 20 is shown incorporated within a modular desk assembly 22, which generally comprises a pair of work surfaces 24,26, a plurality of drawers 28 in movable pedestal 29, overhead cabinets 30, and a free standing or movable pedestal 32. This particular embodiment of remote control desk locking mechanism 20 has remote control lock actuator 34 disposed within work surface 24 and a plurality of cables 36 slidably received within a respective plurality of sheaths 38 connecting various locking devices to remote control lock actuator 34.

Drawers 28 and drawers 40, which serve as closure means for pedestals 29 and 32, respectively, utilize the same type locking device 42 as illustrated in FIGS. 1, 3, 4 and 5. Each of the drawers 40, which are conventionally received in movable pedestal unit 32, has a notch 44 (FIG. 4) disposed in its bottom side edge 46. Locking device 42 includes slide member 48 slidably disposed within vertical slot 50 in pedestal wall 52 (FIG. 3), and rocker arm 58 which is pivotably attached to pedestal wall 52 by means of a pivot joint, e.g., shoulder screw 60. Slide member 48 is operably connected to rocker arm 58 by pin 62 being received within slotted opening 64 of rocker arm 58. Preferably, screw 60 is located midway between pin 62 and pin 66. Slotted opening 64 allows arm 58 to move relative to pin 62 to convert rotational movement to linear movement.

A spring 68 has one end connected to rocker arm 58 by pin 66 and its opposite end connected to a bottom portion of slot 56 by fastener 70. Spring 68 biases rocker arm 58 such that rocker arm 58 moves in a clockwise motion about screw 60 should cable 36 be severed or otherwise fail. If this should occur, the clockwise rotation of rocker arm 58 about screw 60 causes slide member 48 to move upwardly to engage horizontally disposed locking pin 72 with notch 44 to thereby provide an automatic locking feature. An end portion of cable 36 is then attached to rocker arm 58 so that pin 66 is placed between the connection of cable 36 and screw 60.

Figure 6:
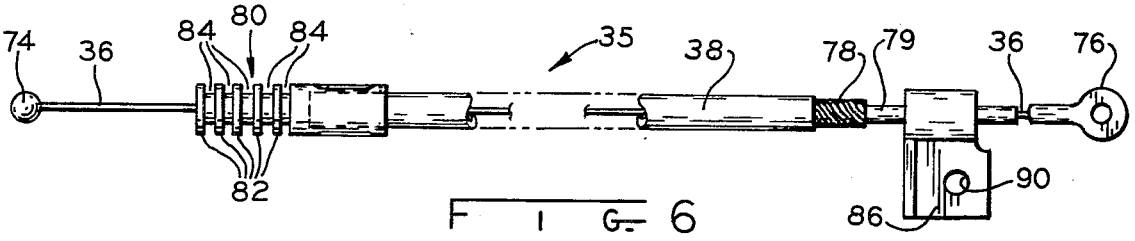
FIG. 6 is a partially cut-away view of a cable slidably encased within a sheath illustrating the end portions thereof.
Figure 4:
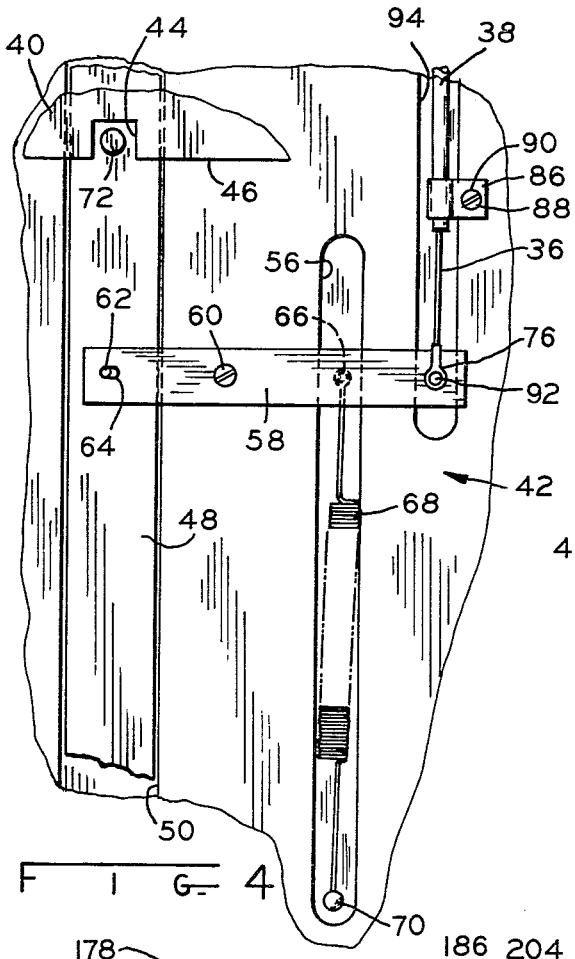
FIG. 4 is an enlarged fragmentary side elevational view of the locking device of FIG. 3 in the locked position.
Figure 5:
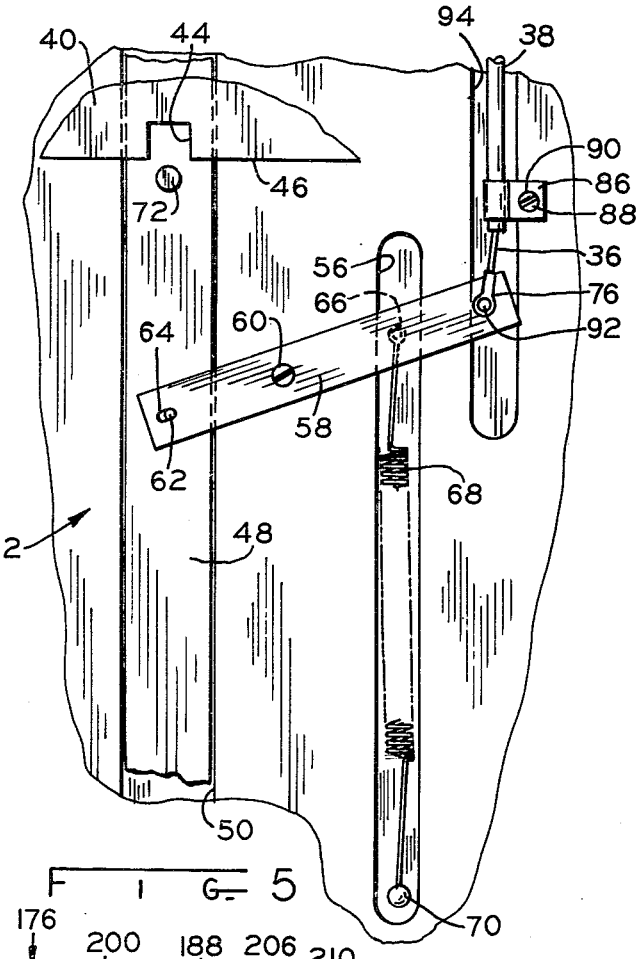
FIG. 5 is similar to FIG. 4 with the locking device in the unlocked position.

A description of cable assembly 35 will now be made in conjunction with FIG. 6. It is preferred that cable 36 be made of a material such as stainless steel, e.g., 0.036" diameter cable 3×7 stainless steel, and that sheath 38 be made of a material such as polypropylene or a like material exhibiting the same properties of flexibility and inextensibility. One end of cable 36 has diecast zinc ball 74 joined thereto and a zinc diecast eyelet 76 joined on its opposite end. The inner surface of sheath 38 is provided with windings 78, e.g., short lay, 16 wire steel ¾ pitch, 0.230 O.D., and liner 79, e.g., polytetrafluoroethylene, which reduces wear on sheath 38 caused by cable 36 being moved therethrough. An adjusting sleeve 80 is disposed on the end of sheath 38 near ball 74 of cable 36 and comprises a plurality of alternating ribs 82 and indentations 84. The opposite end of sheath 38 has anchor bracket 86 secured thereto and is attached to pedestal wall 52 by means of a fastener such as screw 88 received through hole 90 (FIG. 4). Eyelet 76 of cable 36 is pivotably connected to rocker arm 58 by a fastener such as rivet 92. Note that rivet 92 is outboard of pin 66 relative to screw 60. Also illustrated in FIGS. 4 and 5 is a recess 94 for receiving cable 36 and sheath 38 therein to keep them clear of drawers 40 during their movements in movable pedestal 32. In a typical working embodiment, sheath 38 has a diameter of approximately one-quarter inch.

Cable assembly 35 is technically termed a contiguous short lay, lined casing, tension-type control, and provides design simplicity, reliability and engineering flexibility. Further, assembly 35 permits precise positive control on tension strokes with minimal noise or vibrations, is quiet in operation, and is virtually maintenance free. However, it should be understood that assembly 35 may be a Bowden cable made of various materials, both wound and unwound, and made as a multi- or monofilament strand.

Figure 7:
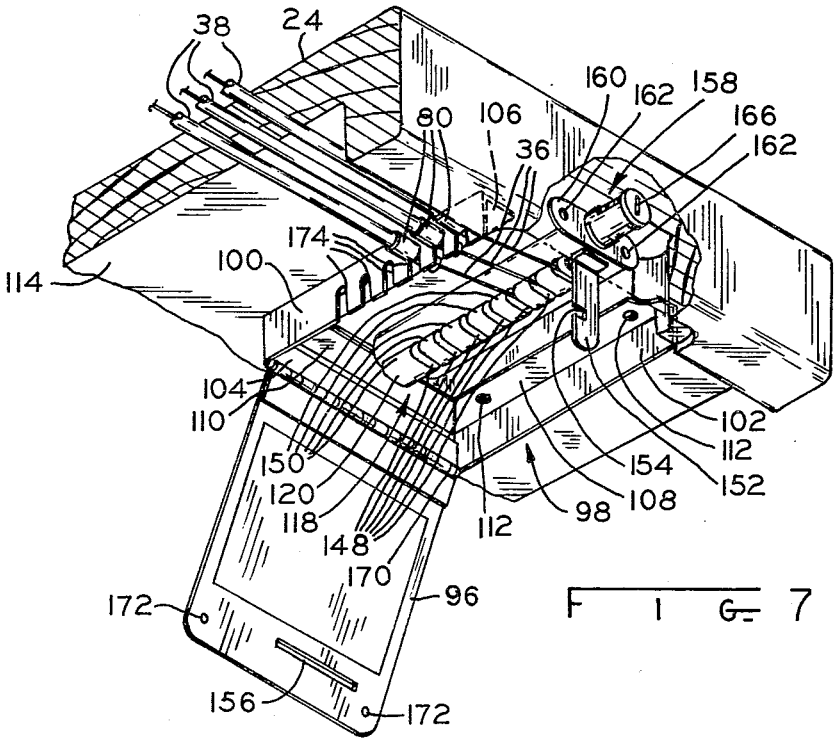
FIG. 7 is a perspective view of a remote control lock actuator of a preferred embodiment of the present invention.
Figure 8:
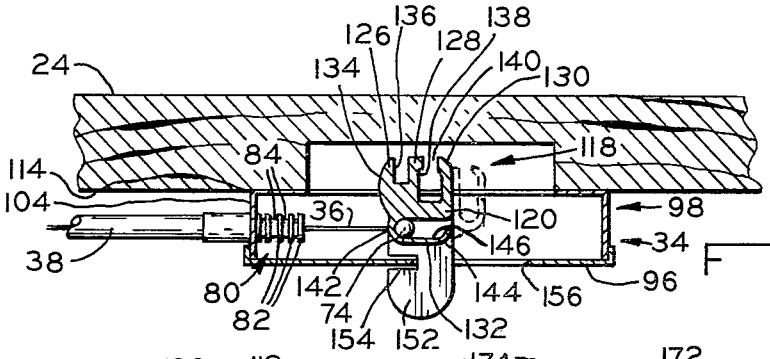
FIG. 8 is an elevational view of the remote control lock actuator of FIG. 7 with the door closed and locked.
Figure 9:
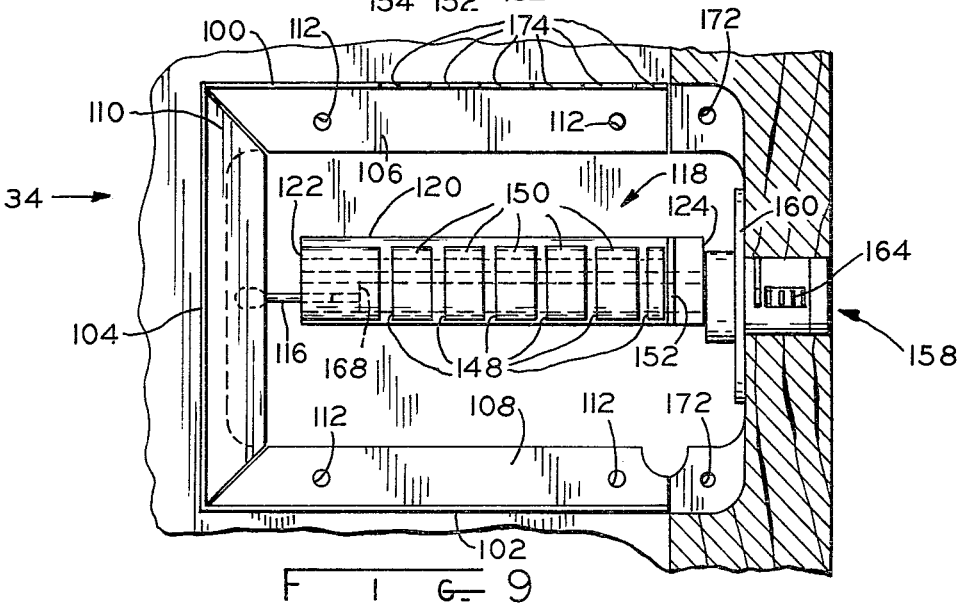
FIG. 9 is a bottom plan view of FIG. 8 with the door removed.

Referring now to FIGS. 7, 8 and 9, a description of remote control lock actuator 34 will be made, it being understood that remote control lock actuator 34 although shown disposed in modular desk assembly 22 as illustrated in FIG. 1 may be located away from desk assembly 22 and enclosed within a separate secure housing. However, the following description will be made with remote control lock actuator 34 disposed within work surface 24 of modular desk assembly 22.

Referring now to FIG. 7, which is a perspective view of remote control lock actuator 34 in its locked position with door 96 open, lock actuator 34 has a housing 98 comprising opposite and parallel side walls 100,102 joined together by end wall 104. Extending horizontally and inwardly from side walls 100, 102 and end wall 104 are top flanges 106, 108 and end flange 110, respectively (FIG. 9). Top flanges 106,108 have holes 112 therein for securing housing 98 to the underside 114 of work surface 24. A pin 116 is secured to end flange 110 by spot welding for example and extends inwardly of housing 98 and parallel to side walls 100,102.

Referring now to FIGS. 7, 8 and 9, a central lock member 118 is illustrated in its normal position within housing 98. Central lock member 118 is preferably extruded of aluminum and comprises a generally cylindrically-shaped main body 120 having opposite ends 122,124 and four walls 126, 128, 130, 132 extending therebetween (FIG. 8). Walls 126, 128, 130 generally lie in planes parallel to each other and perpendicular to the plane of wall 132. Referring specifically to FIG. 8, wall 126 has a groove side 134 and forms with wall 128 an elongated curve 136 having a generally rectangular cross section. In a similar manner, walls 128, 130 form shaped groove 138 with a narrow throat 140 formed by remote end portions of walls 128,130.

Still referring to FIG. 8, wall 132 is joined to main body 120 by curved portion 142, which is formed to conformably receive ball 74 of cable 36, and curved end portion 144 which extends inwardly of groove 146 formed by wall 132 and main body 120. Wall 132 is spaced from main body 120 a distance slightly greater than the diameter of ball 74.

Viewing FIGS. 7 and 9, wall 132 has a plurality of slots 148 disposed therein and which are generally perpendicular to the longitudinal axis of main body 120. Slots 148 form a plurality of fingers 150 along the length of wall 132. Fingers 150 are spaced apart a distance sufficient to permit a ball 74 to be received therebetween so as to be received within groove 146 and conformably seated against curved portion 142.

Secured at end 124 of main body 120 is lock tab 152 having a tab cut-out 154 therein which engages door 96 upon lock tab 152 being received through slot 156 in door 96 (FIG. 8). In this position, lock tab 152 has secured door 96 to housing 98 to prevent unauthorized personnel access thereto. Key lock device 158 is attached to end 124 of main body 120 and comprises mounting flange 160 with holes 162 therein, tumbler assembly 164, and key hole 166. Inserted within shaped-groove 138 at end 122 of main body 120 is bushing 168 made from extruded plastic for example. Central lock member 118 is mounted within housing 98 by pin 116 being rotatably received in bushing 168 and securing mounting flange 160 to underside 114 of work surface 24 by screws (not shown) being received through holes 162 and secured within underside 114. Door 96, which is connected to housing 98 by hinge 170, may be further secured to housing 98 by closing the door and installing screws through holes 172 and into underside 114.

Still referring to FIGS. 7, 8 and 9 side wall 100 of housing 98 has a plurality of slotted openings 174 therein and into which may be received a respective plurality of adjusting sleeves 80. This end of sheath 38 is secured by positioning one of the indentations 84 of adjusting sleeve 80 within its respective slotted opening 174. By positioning different indentations 84 of the same sheath 38 in a respective slotted opening 174, the effective length of sheath 38 may be varied between its two points of securement, anchor bracket 86 and side wall 100 of housing 98. This permits the user to make fine adjustments to the length of sheath 38 so as to compensate for any slight errors made in the length of sheath 38 during its manufacture in conjunction with its respective cable 36. Proper connection of cable 36 and sheath 38 to remote control lock actuator 34 is depicted in FIG. 8 wherein a ball 74 is conformably seated within groove 146 of main body 120 and adjusting sleeve 80 secured in its respective slotted opening 174. FIG. 8 depicts remote control lock actuator 34 in its locked position, the dashed line drawing of wall 132 depicting its position when lock actuator 34 is in its unlocked position.

As an alternative for some applications, a screw adjustment (not shown) for the cable may be used. In this case, the end of sheath 38 would be provided with an internally threaded sheath and be threadedly connected to an externally threaded sleeve keyed into slot 174. The cable 36 itself would extend through both sleeves and be connected by the ball and groove arrangement already described. Because the threads on the sleeve are located inside housing 98 and the sleeve is keyed to slot 174, the threaded adjustment cannot be tampered with once the housing 98 is locked.

As depicted in FIGS. 1 and 2, sheath 38 connecting remote control lock actuator 34 with movable pedestal 32 may be longer than the distance therebetween so as to allow movable pedestal 32 to be moved out of and away from modular desk assembly 22 and yet still provide a locking and unlocking capability to drawers 40 of pedestal 32. When remote control desk lock mechanism 20 is installed as above described, door 96 may be closed, and a key may be inserted in key hole 166 and turned to lock locking tab 152 into slot 156 and also position central lock cylinder 118 as depicted in FIG. 8. In this position, sufficient slack is provided to a respective cable 36 to allow its respective spring 68 (FIGS. 4 and 5) to pull rocker arm 58 downwardly and slide member 48 upwardly to engage locking pin 72 with drawer notch 44, thereby locking the respective drawer in place. The drawers or other storage compartments thus locked may be unlocked by reinserting the key in key hole 166 and rotating it approximately 90° counterclockwise to position central lock cylinder 118 as depicted in dotted lines in FIG. 8. This rotation of central lock member 118 causes wall 132 to pull against ball 74 and cable 36 to overcome the force exerted by spring 68 on rocker arm 58. This rotation naturally moves rocker arm 58 in a counterclockwise position relative to screw 60 to downwardly move slide member 48 to thereby disengage locking pin 72 from its drawer notch 44. Further, once this particular rotation has been made, locking tab 152 rotates with main body 120 to thereby rotate out of slot 156 and unlock door 96, and, upon the key being removed from key hole 166, tumbler assembly 164 of key lock device 158, which may be of conventional design, locks main body 120 in its dotted line position of FIG. 8. In the unlocked position, door 96 may be opened and adjustments to sheaths 38 may be made by means of adjusting sleeves 80, or other cables 36 and sheaths 38 may be likewise attached to remote control lock actuator 34. It should be noted that in FIG. 7 door 96 has been left open with locking tab 152 in the downward locked position for visual purposes only. Generally, with locking tab 152 in the position illustrated in FIG. 7, door 96 will be closed and locked as illustrated in FIG. 8.

Although the description above of remote control desk locking system 20 has been made in reference to typical drawers such as drawers 28,40, this is not limitative and this particular embodiment of remote control desk locking mechanism 20 may be adapted to other storage compartments having closure means different from drawers 28,40. This versatility, along with the provided feature of having a sheath 38 substantially longer than the distance between remote control lock actuator 34 and the storage compartment to be locked, also applies to the alternate embodiments hereinafter described.

Figure 10:
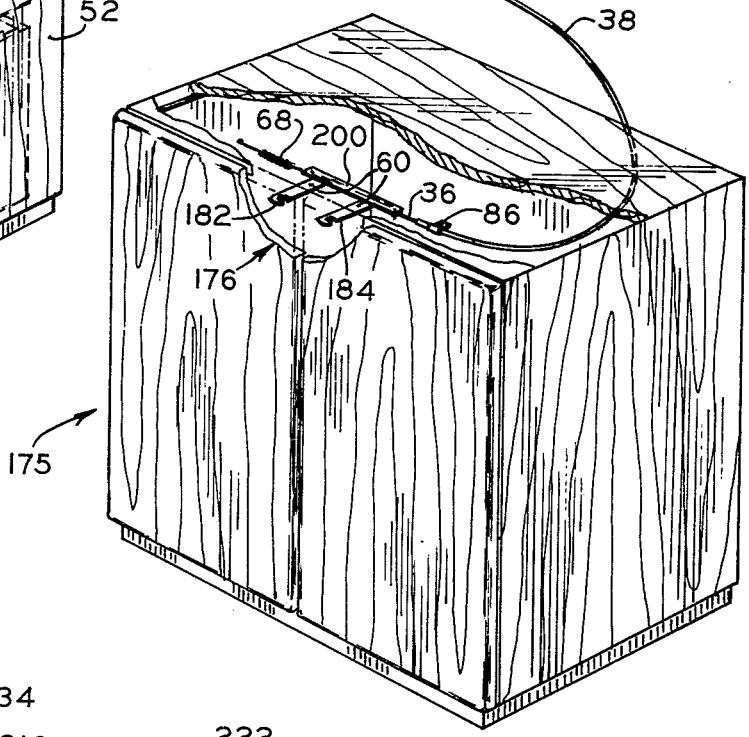
FIG. 10 is a perspective view of a storage cabinet incorporating a locking device of a preferred embodiment of the present invention.
Figure 11:
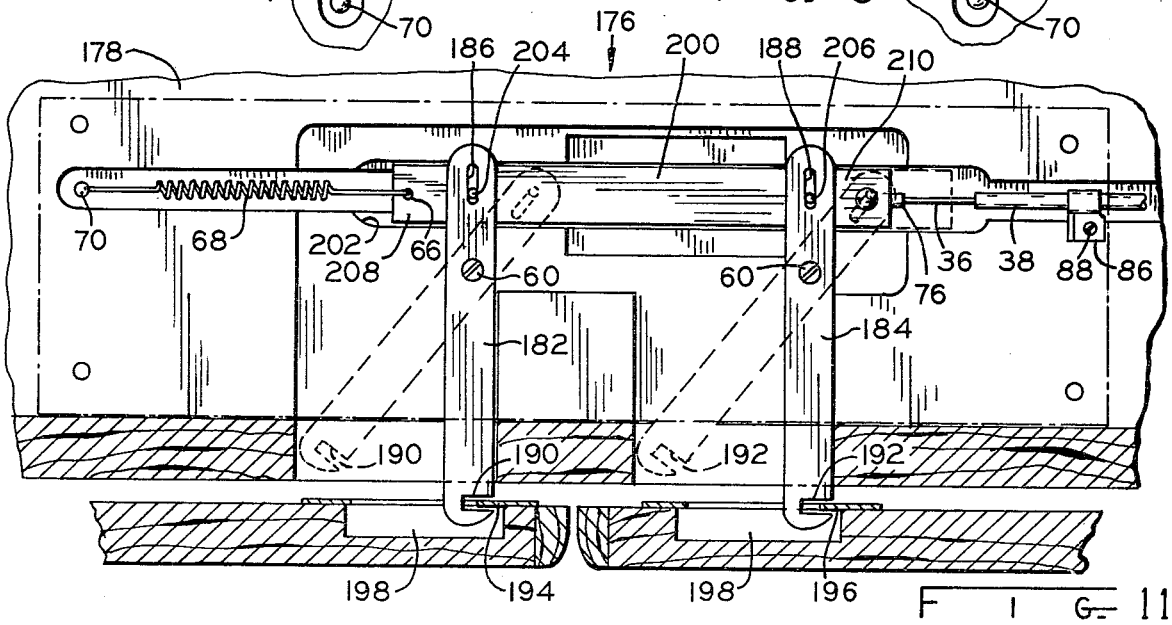
FIG. 11 is an enlarged fragmentary plan view of the locking device for the storage cabinet of FIG. 10.

In the below descriptions of alternate embodiments where appropriate, elements similar to those above will have the same reference numerals. Referring to FIGS. 1, 2, 10 and 11 remote control desk lock mechanism 20 will be described in connection with storage compartments such as overhead cabinets 30 and a double door storage cabinet 175 (FIG. 10). A description of only overhead cabinets 30 will be made since double door storage cabinet 175 may be locked and unlocked in an identical manner. Overhead cabinets 30 may utilize a scissors lock device 176 as illustrated in FIG. 11 and installed in modular desk assembly 22 in FIG. 1. Scissors lock device 176 is attached to bottom surface 178 of modular desk assembly 22 for locking doors 180, which are closure means for cabinets 30.

Specifically referring to FIG. 11, scissors lock device 176 comprises lever arms 182,184, both of which have a respective screw 60, slots 186,188, respectively, and lock grooves 190,192. Lever arms 182,184 are connected to bottom surface 178 so that lock grooves 190,192 may engage respective lock tabs 194,196 disposed in each door 180. Spaces 198 are disposed in doors 180 to permit proper engagement between lock grooves 190,192 and lock tabs 194,196.

Slide bar 200 is slidably received in slot 202 of bottom surface 178 and has two pins 204,206 received through respective slots 186,188 of lever arms 182,184, and a spring 68 is connected to bottom surface 178 and end portion 208 of slide bar 200, the connection being made in any suitable manner. The opposite end portion 210 of slide bar 200 may be attached to a cable 36 in a manner similar to the attachment of a cable 36 to rocker arm 58. Likewise, sheath 38 is attached to bottom surface 178 by means of an anchor bracket 86 and a screw 88. The opposite ends of cable 36 and sheath 38 are connected to remote control lock actuator 34 as earlier described, and fine adjustments to the length of sheath 38 may be made also as earlier described.

In the case of double door storage compartment 175, which may be set apart and moved relative to modular desk assembly 22, its sheath 38 and cable 36 may have a sufficient length, to allow cabinet 175 to be moved relative to remote control lock actuator 34.

In the operation of scissors lock device 176 in conjunction with remote control desk lock mechanism 20, spring 68 biases slide bar 200 to the left as viewed in FIG. 11 causing lever arms 182, 184 to rotate about their screws 60 in a counter-clockwise manner to engage lock grooves 190, 192 with lock tabs 194, 196 respectively, of doors 180. When main body 120 of central lock member 118 is rotated with a key, as earlier described, to the unlocked position as indicated in dotted lines in FIG. 8, cable 36 pulls against spring 68 to rotate lever arms 182,184 clockwise about their respective screws 60 to thereby disengage lock grooves 190,192 from lock tabs 194,196 as indicated in dotted lines in FIG. 11. Should cable 36 be severed or fail, spring 68 will automatically rotate the lever arms 182,184 to automatically lock doors 180.

Figure 12:
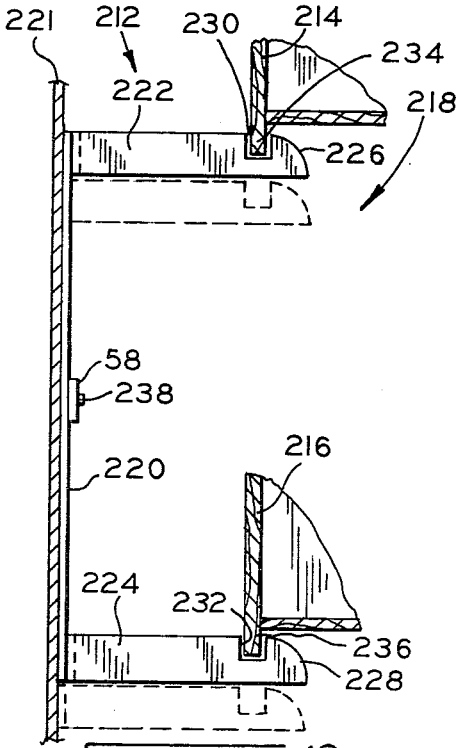
FIG. 12 is a partially cut-away side elevational view of a locking device for a filing cabinet.
Figure 13:
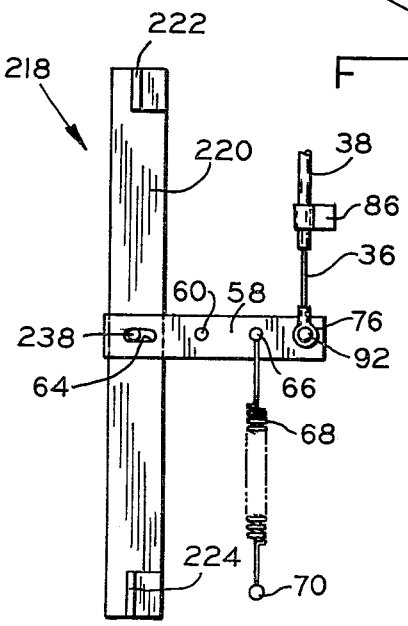
FIG. 13 is an end elevational view of the locking device of FIG. 12 with the filing cabinet portion removed therefrom.

FIGS. 12 and 13 illustrate remote control desk lock mechanism 20 installed with a conventional filing cabinet 212, a portion of which is shown in FIG. 12. As illustrated, two drawers 214,216, which are closure means for filing cabinet 212, are shown as being locked, and, in dotted lines, unlocked. Lock device 218 of filing cabinet 212 has a vertically slidable slide member 220 with locking arms 222,224 which have curved end surfaces 226,228 and locking slots 230,232, respectively. Slide member 220 is vertically slidable in channel or slot (not shown) in a manner similar to which slide member 48 moves in slot 50. The channel or slot for slide member 220 may be attached to the inner surface of the back wall 221 of filing cabinet 212. Locking slots 230, 232 are adapted to lock and unlock drawers 214,216, respectively, by engaging the bottom edges 234,236 thereof.

A rocker arm 58 is pivotably attached to the side of filing cabinet 212 by screw 60, and has in one end thereof slotted opening 64 for engaging pin 238 of slide member 220 and on the other side of screw 60 a pin 66 for connecting spring 68 thereto. The opposite end of spring 68 is connected to the side of the filing cabinet 212 by a fastener 70, the remote end of rocker arm 58 is connected to cable 36 as earlier described by a rivet 92, and sheath 38 is connected to the side of filing cabinet 212 by means of anchor bracket 86.

The operation of locking device 218 is similar to locking device 42 except that locking arms 222,224 are utilized to engage bottom edges 234,236 to lock drawers 214,216 in filing cabinet 212. Additionally, if cable 36 should be severed or fail, spring 68 will cause rocker arm 58 to pivot in a clockwise manner about screw 60 thereby moving slide member 220 upwardly to lockingly engage lever arms 222,224 as described. If either drawer 214,216 should be open during such a failure or severance of cable 36, or upon locking remote control lock actuator 34, the open drawer may be closed and locked by the camming action provided by either curved end surface 226 or 228, which will cause slide member 220 to move downwardly so that a respective locking slot 230,232 may engage its respective bottom edge 234,236. Once engaged, spring 68 will cause slide member 220 to move upwardly to complete the locking sequence.

As described above, it may be seen that remote control desk locking mechanism 20 may be uniquely adapted to lock various types of storage compartments and yet permit the storage compartments to be moved or rearranged as desired by the user within the length of a sheath 38. Furthermore, remote control lock actuator 34 may be positioned at a more convenient location other than within a work surface 24 of a modular desk assembly 22, thereby lending further versatility to the mechanism 20.

While this invention has been described as having specific embodiments, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A remote control locking mechanism for desks, pedestals, cabinets and like assemblies, comprising:

a work station including a plurality of storage compartments, each said storage compartment having closure means for the opening and closing thereof, a plurality of lock means at respective ones of said storage compartments for locking respective said closure means, each said lock means having operably connected thereto and extending therefrom a cable slidably encased in a sheath member, each said sheath member having its end portions anchored in place and encasing a substantial length of its respective said cable, and a single remote actuator having said cables connected thereto, said remote actuator including means for simultaneously moving each said cable relative to its respective said sheath member to actuate said lock means for locking and unlocking said closure means.

2. The mechanism of claim 1 including a plurality of bias means connected to respective said lock means, each said bias means biasing a respective said lock means to lock said closure means when the respective cable is released so that a respective said lock means locks a respective said closure means upon severance of said cable interconnected thereto.

3. The mechanism of claim 1 wherein said storage compartments include a movable free standing storage compartment having a respective one of said cables encased in a respective one of said sheath members operably connected to a respective said lock means of said movable storage compartment, said one sheath member having one end portion anchored at said movable storage compartment, said one cable and one sheath member having slack lengths to permit said movable storage compartment to be moved relative to said work station within the lengths thereof.

4. The mechanism of claim 3 wherein said sheath member of said one cable is made of a flexible and substantially inextensible material.

5. The mechanism of claim 1 wherein said sheath members are made of a flexible and substantially inextensible material.

6. The mechanism of claim 1 wherein said remote actuator is disposed within said work station.

7. The mechanism of claim 1 further comprising additional remote actuators having certain ones of said cables extending therefrom to their respective said lock means to provide selective locking and unlocking of said closure means.

8. The mechanism of claim 1 further comprising a housing containing said remote actuator therein, said housing including an access means lockable by a locking device operably connected to said moving means, and wherein said moving means simultaneously operates said locking device to lock said access means when actuating said cables to lock said lock means and to unlock said access means when actuating said cables to unlock said lock means.

9. The mechanism of claim 1 wherein said work station includes a work surface, and wherein said plurality of storage compartments includes a pedestal under said work surface, said pedestal having a drawer for the opening and closing thereof, and an overhead cabinet secured to said work surface, said overhead cabinet having a door for the opening and closing thereof.

10. The mechanism of claim 9 wherein said plurality of storage compartments further includes a movable pedestal with a drawer.

11. A remote control locking mechanism for desks, pedestals, cabinets and like assemblies, comprising:

a work station including a first work station component and a storage compartment having a closure means for the opening and closing thereof, said storage compartment being located remotely from said first component and being movable relative thereto, lock means located at and connected to said closure means of said storage compartment for locking said closure means, a cable slidably disposed in a sheath member and extending from said lock means to said first component location, said sheath member having its end portions anchored to said first component and said storage compartment, respectively, and encasing a substantial length of said cable, and an actuating device on said first component to which said cable and said sheath member lead, said actuating device including means for moving said cable in said sheath member to actuate said lock means to lock and unlock said closure means of said storage compartment, there being slack in said cable and said sheath member to permit movement of said storage compartment relative to said first component.

12. The mechanism of claim 11 wherein the end portion of said sheath member leading said actuating device has a plurality of surface irregularities, and including adjusting means including engaging means for interchangably securing a selected one of said surface irregularities on said sheath member, thereby permitting adjustment of the length of said sheath member between its two anchoring points on said first component and said storage compartment.

13. The mechanism of claim 11 wherein said moving means of said actuating device includes a rotatable member having an end portion of said cable attached thereto so that said cable is moved back and forth in said sheath member when said rotatable member is rotated back and forth, thereby actuating said lock means.

14. The mechanism of claim 11 wherein said sheath member is made of a flexible and substantially inextensible material.

15. A locking mechanism for desks, pedestals, cabinets and the like, comprising:

a work station including a storage compartment having a closure means for the opening and closing thereof, lock means at said storage compartment for locking said closure means, a cable slidably disposed in a sheath member and extending from said lock means, said sheath member having its end portions anchored between two spaced-apart points and encasing a substantial length of said cable, an actuating assembly remotely disposed from said storage compartment and having said cable and said sheath member leading thereto, said remote actuating assembly including means for moving said cable relative to said sheath member to cause said lock means to lock and unlock said closure means, and a housing enclosing said remote actuating assembly and having an access means to allow access to said remote actuating assembly therein, said moving means including a locking device engagable with said access means to lock said housing when said moving means causes said lock means to lock said closure means and to unlock said housing when said moving means unlocks said lock means.

16. The mechanism of claim 15 wherein said actuating assembly is remote from said work station.

17. The mechanism of claim 15 wherein said moving means of said actuating assembly includes a rotatable member having an end portion of said cable connected thereto so that said cable is moved back and forth in said sheath member when said rotatable member is rotated back and forth to actuate said lock means.

18. The mechanism of claim 17 wherein said locking device is connected to said rotatable member so that said locking device locks said access means when said rotatable member is rotated to actuate said lock means to lock said closure means.

19. A remote control locking mechanism for desks, pedestals, cabinets and the like, comprising:

a movable, free standing storage compartment having closure means for the opening and closure thereof, lock means disposed on said movable, free standing storage compartment for locking said closure means, a cable slidably encased in a sheath member and extending from said lock means, said sheath member having one end portion anchored at said movable, free standing storage compartment and encasing a substantial length of said cable, and a remote actuator having said cable leading thereto, said remote actuator including means for moving said cable relative to said sheath member to actuate said lock means for locking and unlocking said closure means, said cable and said sheath member having sufficient lengths to allow said movable, free standing storage compartment to be moved relative to said remote actuator within the lengths thereof.

20. The mechanism of claim 19 wherein said lock means is connected to a bias means, said bias means biasing said lock means to lock said closure means upon said cable becoming inoperative.

21. The mechanism of claim 19 wherein said lock means includes a slide bar slidably disposed in said storage compartment, said slide bar having a locking pin for engaging a lock detent in said closure means, and a lever arm pivotably connected to said storage compartment and having one end connected to said slide bar and its opposite end connected to said cable, whereby said slide bar is moved by said lever arm to engage and disengage said locking pin with said lock detent when said cable is moved back and forth by said moving means.

22. The mechanism of claim 19 further comprising a plurality of storage compartments each having a closure means for the opening and closing thereof, and lock means disposed on each said storage compartment for locking a respective said closure means, each said lock means having a cable slidably encased in a sheath member extending therefrom, said sheath members having their end portions anchored in place and encasing a substantial length of respective said cables, said cables leading to said remote actuator and being movable by said moving means to thereby lock and unlock respective said lock means of respective said closure means.

23. The mechanism of claim 19 wherein said sheath member is made of a flexible and substantially inextensible material.

* * * * *